US007604102B2

(12) United States Patent
Albritton

(10) Patent No.: US 7,604,102 B2
(45) Date of Patent: Oct. 20, 2009

(54) SPORTS EQUIPMENT BAG, ORGANIZER AND VENTILATOR

(75) Inventor: Kenneth B. Albritton, Ashland, VA (US)

(73) Assignee: Gearmax USA Ltd, Mechanicsville, VA (US)

( * ) Notice: Subject to any disclaimer, the term of this patent is extended or adjusted under 35 U.S.C. 154(b) by 1242 days.

(21) Appl. No.: 09/995,615

(22) Filed: Nov. 29, 2001

(65) Prior Publication Data

US 2002/0074199 A1 Jun. 20, 2002

Related U.S. Application Data

(60) Provisional application No. 60/255,060, filed on Dec. 14, 2000.

(51) Int. Cl.
*A45C 7/00* (2006.01)

(52) U.S. Cl. ..... 190/107; 190/109; 190/113; 383/4; 206/284; 206/287; 224/653; 224/652

(58) Field of Classification Search ..... 383/4; 190/109, 108, 110, 113; 224/153, 584, 652, 224/653, 657, 658, 659, 681; 206/284, 286, 206/288, 287

See application file for complete search history.

(56) References Cited

U.S. PATENT DOCUMENTS

| | | | | | |
|---|---|---|---|---|---|
| 140,548 | A | * | 7/1873 | Scott | 190/109 |
| 2,205,205 | A | * | 6/1940 | King | 190/901 |
| 2,254,578 | A | * | 9/1941 | O'Brien | 190/109 |
| 2,626,689 | A | * | 1/1953 | Davis et al. | 206/287.1 |
| 3,777,862 | A | * | 12/1973 | Zipper | 190/109 |
| 3,802,613 | A | * | 4/1974 | Droeger | 224/153 |
| 4,059,464 | A | * | 11/1977 | Geller et al. | 190/107 |
| 4,423,834 | A | * | 1/1984 | Rush | 224/151 |
| 4,542,824 | A | | 9/1985 | Allen | |
| 4,655,343 | A | | 4/1987 | Lane et al. | |
| 4,693,368 | A | | 9/1987 | King et al. | |
| RE32,658 | E | | 5/1988 | Myers et al. | |
| 4,901,897 | A | | 2/1990 | Briggs et al. | |
| 5,054,589 | A | * | 10/1991 | Bomes et al. | 190/18 A |
| 5,413,198 | A | | 5/1995 | Ferris | |
| 5,425,449 | A | | 6/1995 | Boorady | |
| 5,575,362 | A | * | 11/1996 | Franklin et al. | 190/115 X |
| 5,584,422 | A | * | 12/1996 | Bond-Madsen | 190/903 |
| 5,588,529 | A | | 12/1996 | Speck | |

(Continued)

OTHER PUBLICATIONS

"Rolling Bag," retrieved on Nov. 18, 2002 from Internet at <http://www.diamond-sports.com/Catalog/Bags/Images/RollingLkrTote-Hanging.JPG>.

*Primary Examiner*—Tri M Mai
(74) *Attorney, Agent, or Firm*—MaxValueIP, LLC

(57) ABSTRACT

A bag includes a back wall having a hook accommodating the hanging of the bag when opened, a plurality of compartments on a front surface of the back wall, the plurality of compartments having a front portion being of a mesh material accommodating a view of the objects and a circulation of air within the compartments. The compartments can have shelves projecting from the back wall to accommodate the objects. The wall can be folded or rolled to close the back wall into the bag for carrying by the handles through hands or on a back of a user. A locking bar on a zipper enclosing the bag can be used to secure the bag to a locker.

13 Claims, 13 Drawing Sheets

U.S. PATENT DOCUMENTS 5,628,397 A 5/1997 Ham
5,749,503 A * 5/1998 Wulf et al. ..... 224/153
5,893,495 A * 4/1999 Godshaw et al. ..... 224/153
5,988,476 A * 11/1999 Olerio ..... 224/630
6,009,995 A 1/2000 Speck
6,076,485 A 6/2000 Peeples et al.
6,129,254 A * 10/2000 Yu ..... 190/18 A
6,135,635 A 10/2000 Miller et al.
6,161,738 A * 12/2000 Norris ..... 224/153
6,193,034 B1 2/2001 Fournier
6,196,718 B1 * 3/2001 DeChant ..... 190/109 X
6,286,461 B1 * 9/2001 Martz ..... 224/153 X
6,334,519 B1 * 1/2002 Tong ..... 190/107
6,386,414 B1 * 5/2002 Kilduff ..... 224/638
6,471,105 B1 * 10/2002 Ammerman et al. ..... 224/625

* cited by examiner

Fig. 6
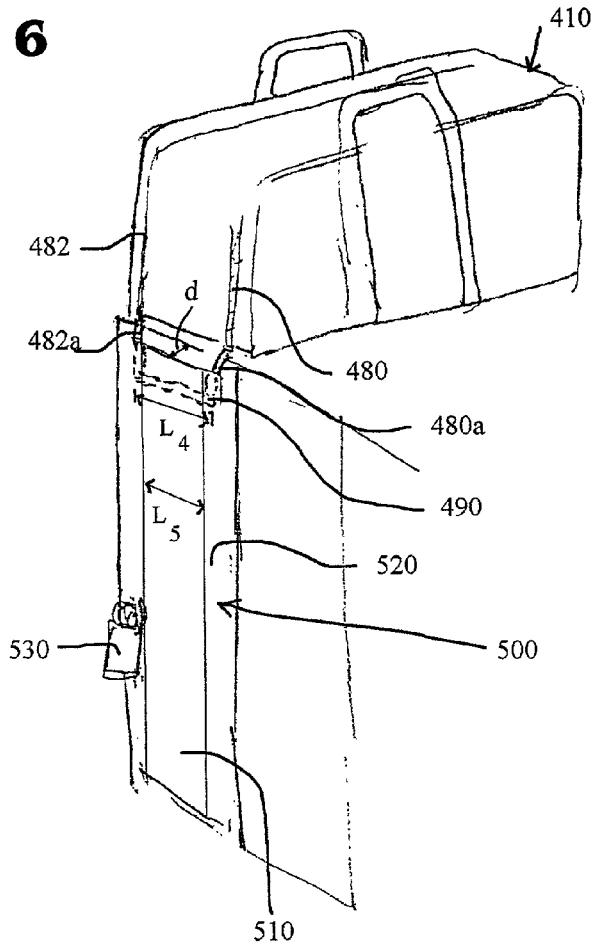
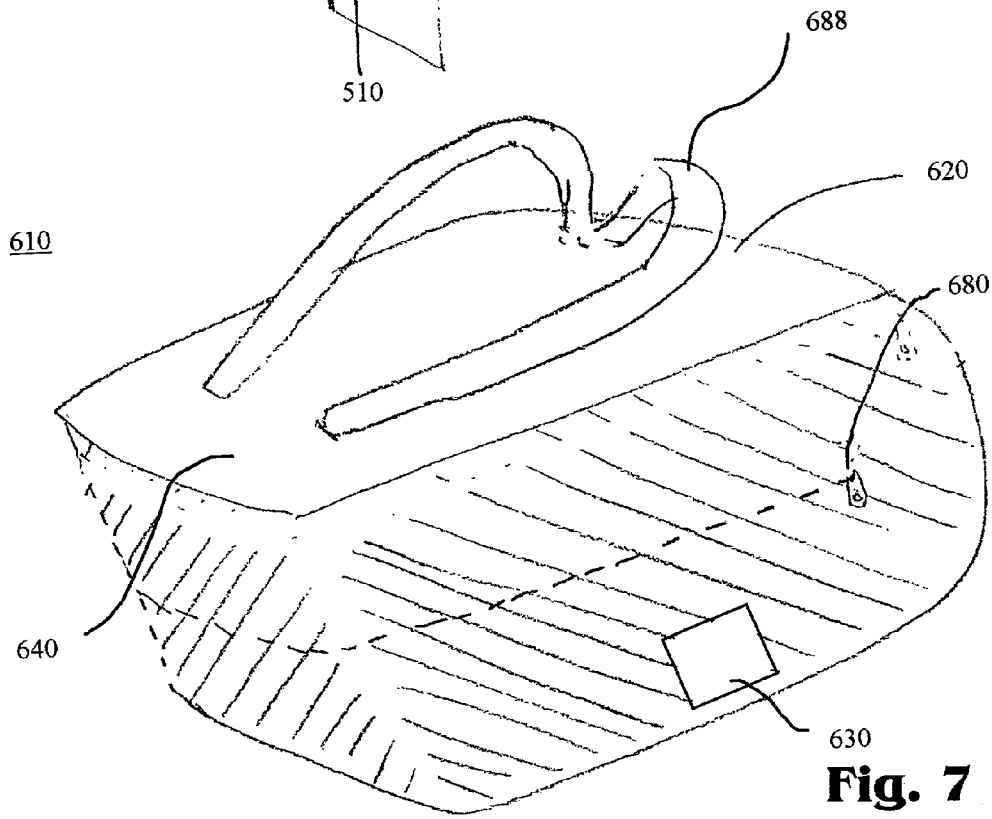
Fig. 7

SPORTS EQUIPMENT BAG, ORGANIZER AND VENTILATOR

CLAIM OF PRIORITY

This application makes reference to, incorporates the same herein, and claims all benefits accruing under 35 U.S.C. §119 from a provisional application entitled Sports Equipment Bag-Organizer and Ventilator earlier filed under 35 U.S.C. §111(b) in the United States Patent and Trademark Office on 14 Dec. 2000 and there duly assigned Ser. No. 60/255,060, and a disclosure document entitled Sports Equipment Organizer with Locking Device on 22 Mar. 2001 and there duly assigned Disclosure Document No. 490860.

BACKGROUND OF THE INVENTION

1. Field of the Invention

The present invention relates to a sports equipment bag, and more particularly, to a bag for organizing sports equipment and related articles while providing ventilation for the sports equipment and the related articles.

2. Description of the Background Art

In athletic activities such as hockey, baseball, football, or inline skating, a person may have to carry uniforms, a face mask, helmets, knee pads, and other assorted sports equipment. The assorted equipment has usually been just placed in a bag where it has been difficult to take out the sometimes heavy and cumbersome equipment and also to perform a visual inventory of the bag. Another problem with the earlier sports equipment bags was that the equipment and clothing articles related to the sports accumulated perspiration. The bag would cause an increased odor because of the lack of proper ventilation. The damp garment, sports, and athletic equipment, boots and shoes were dried out on purchased racks or spread around on the floor or on furniture. Garments and sports equipment that retain water will mold, mildew, and develop unpleasant odors without adequate air circulation. Equipment in a bag should be dried out, so there is an aggravation of removing equipment from the bag to dry the equipment because if the equipment is left in the bag, there can be damage to equipment if the equipment cannot fully dry. It is a cumbersome process of taking the equipment out of the bag. Unloading the conventional sports bag and placing the items around an area to allow for air-drying is time consuming, visually unpleasant, and consumes space. This procedure also increases the chance of misplacing an item and leaving it behind. Conventionally vented bags offer limited benefit due to the density of equipment obstructing air penetration inside the bag.

A travel and sports organizer bag, equipped with a method of air circulation is needed to effectively air dry articles without complex and expensive structures as well as being an organization and space saving tool that allows for quick and easy use.

SUMMARY OF THE INVENTION

It is therefore an object to have a bag that can effectively air dry articles without complex and expensive structures as well as being an organization and space saving tool.

It is another object to have a bag that can have the contents viewed quickly for use. It is yet another object to have a bag that can be locked quickly to a locker without extensive extra parts.

It is still yet another object to have a bag that can ventilate while being in a closed position. It is yet another object to have a bag that can ventilate while being in an open or folded position.

It is another object to have a bag that can be easily hung up to allow a flat view of the contents.

It is yet another object to save time by being able to hang up all contents of a bag at the same time.

It is still another object to have a bag that can organize objects in a bag in a systematic manner.

It is another object to have objects organized in a single plane.

To accomplish the above and other objectives, the present invention provides a bag including a back wall having a hook accommodating the hanging of the bag when opened, a plurality of compartments on a front surface of the back wall, the plurality of compartments having a front portion being of a mesh or netted material accommodating a view of the objects and a circulation of air within the compartments. The compartments can have shelves projecting from the back wall to accommodate the objects. The wall can be folded or rolled to close the back wall into the bag for carrying by the handles through hands or on a back of a user. The bag may include a locking bar or another object designed to prevent removal of the bag (connection accommodating the bag to lock) on a zipper enclosing the bag that can be used to secure the bag to a locker.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein:

FIG. 6 is a plan view of the object holder of FIG. 5 in a closed position and secured to a locker;

FIG. 7 is a perspective view of a backpack having the object holder in a closed position;

DETAILED DESCRIPTION OF THE PREFERRED EMBODIMENTS

Figure 1:
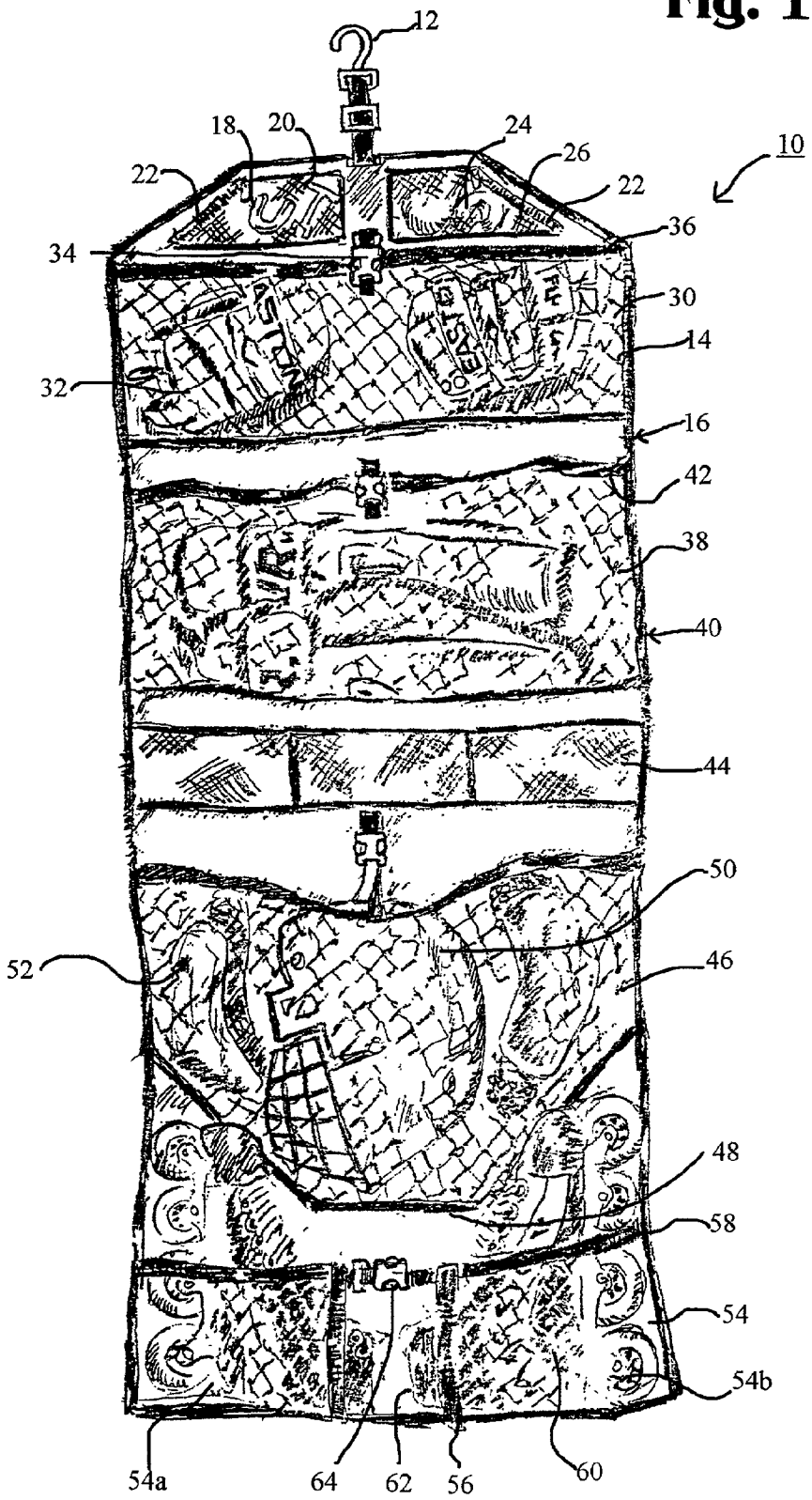
FIG. 1 is a perspective view of the object holder of a bag in an opened flat position.

Turning now to the drawings, as seen in FIG. 1, an object holder 10 can be hung by a hook 12 on to a locker or other stationary area so that the equipment and other articles can be easily seen and used. The object holder 10 can be a bag itself or an insert within another bag. The object holder 10 does not necessarily have to hang vertically or hang at all. The object holder 10 can also be positioned on top of a bench or on a floor horizontally to allow for access to the equipment or any other position where the equipment or objects held by the object holder 10 can be viewed. Objects such as sports equipment, clothing, shoes, boots, ice skates, ski boots, and other objects can be placed in the different compartments of the object holder 10.

The object holder 10 can be made of canvas, vinyl such as PVC (polyvinyl chloride), plastic, other types of polyester or fabric material that allows for folding or rolling up for storage. The object holder 10 can be made of flexible material.

The compartments, or chambers are built into the object holder 10 to accommodate objects to be organized and dried. The chambers or compartments can be expanded to accommodate the articles. One or more zippers 22 or a hook 12 and loop 120, releasable fasteners 34 or velcro along the top of the bag function to close the bag and allow access into the bag chambers to facilitate the introduction of articles into the bag chamber and removal of the articles from the bag. In FIG. 1 for example, a mouth piece 18 is placed in the upper left compartment 20, while the upper right compartment 26 can hold articles such as a puck 24. Both the upper left 20 and upper right 26 compartments can be closed by using zippers 22. Other types of devices other than zippers 22 may be used to close the top compartments. Since the articles are small, the zippers or other similar fasteners help to close the upper left and right compartments 20 and 26.

A third compartment 30 below the upper compartments 22 and 26 may have equipment such as hockey gloves 32. The third compartment 30 may have fasteners 34 allowing for quick access to the hockey gloves 32. A clasp or other fastener 34 can be sufficient for holding the items because when folded, the pressure of the items will hold the items in place. Elastic bands may be used with the snap fasteners 34 to allow for the pocket to be stretched out while placing equipment inside. A portion or all of top border 36 can be of an elastic or resilient material. Velcro may also be used in place of the snap fasteners 34. The top border area 36 which is open for access to the gloves 32 when the fastener 34 is open. However, when the fastener 34 is closed, the top border area 36 is pulled closer to the back portion or wall 16, thereby preventing articles such as the gloves 32 from releasing from the third compartment 30. The bag can be without fastener 34 because once the bag is closed, the pressure of the equipment or gear against each other can prevent articles from falling out.

A fourth compartment 38 disposed below the third compartment 30 is made similar to the third compartment 30. A mesh (netted) material 14 is stitched or connected in some other manner to the border material 40. The border material 40 can be stitched or through another method connected with the back wall 16 of the object holder 10 made of material such as canvas. The upper border material 42 is not connected to the back wall 16, thus allowing access to equipment within the compartment. The compartments can be varied in terms of the size, quantity and location within the bag depending on the sport or activity.

The mesh (netted) material 14 allows for a person to easily locate an equipment item and the mesh also provides for ventilation of the articles. The partially see-through material allows for a fast inventory to confirm that all gear needed is packed. The object holder 10 may either be hung up for ventilation or positioned at any angles such as horizontal to the ground such as on a bench or ground. The object holder 10 just needs to be in the open position as shown in FIG. 1, allowing for exposure of the equipment through the mesh material 14. Materials other than mesh 14 can be used in the alternative such as any other material that allows for ventilation and visibility of equipment stored within the compartment. The mesh material allows the air to be exhausted from the compartments through the air vents.

A fifth compartment 44 below the fourth compartment can have a plurality of sub-compartments that can hold various smaller equipment. The fifth compartment holds smaller items and materials relatively flat and allows the bag to fold over. A sixth compartment 46 below the fifth compartment 44 can be substantially V-shaped or U-shaped having for example a flat portion 48 truncating the vertex of the V-shaped fifth compartment 46. The V-shaped compartment 46 or pocket provides for a helmet 50 or other large object such as a soccer ball that can fit for example between the skates 52 or boots. The V-shape accommodates an efficient use of space and allows for the object holder 10 to sit evenly for easier storage. The helmet 50 sits snugly between the pair of skates allowing not only efficient and easy access, but also better ventilation. Multiple equipment items are not on top of each other to prevent the efficient drying of wet equipment. The middle section such as the fifth compartment 44 needs to be smaller so that it holds smaller items accommodating an easier closing of the bag. The middle section 44 can also be flat to accommodate an easier closing of the bag.

In the seventh compartment 54, the in-line skates 60 or some other pair of boots, are positioned on each end with a top portion 58 of the compartment and the side portions 56 of the compartment 54 being closed. The side portions 56 are not made of a mesh material but of a solid see-through material or a solid material that is not see-through so that when the skates for instance are placed in the seventh compartment 54, the wheels or blades will not wear out the mesh material prematurely. The open area 62 allows for a better ventilation of the boots, since the opening portion of the boots is in an open area 62 allowing for free air flow without even the mesh (netted) surface.

A horizontal fastener 64 is situated between the left and right side 54*a* and 54*b* of the seventh compartment 54. The horizontal fastener 64 as opposed to the vertically disposed fasteners 34 on the other compartments, allow for an efficient access to the boots or inline skates 60. When unattached, the fasteners 64 allow for the top 58 and side portions 56 of the left and right 54*a* and 54*b* of the seventh compartment 54 to open fully to allow for access to the large boots or skates. Other types of equipment may be organized within the compartments or pockets. Other type of fasteners may also be used.

Figure 2:
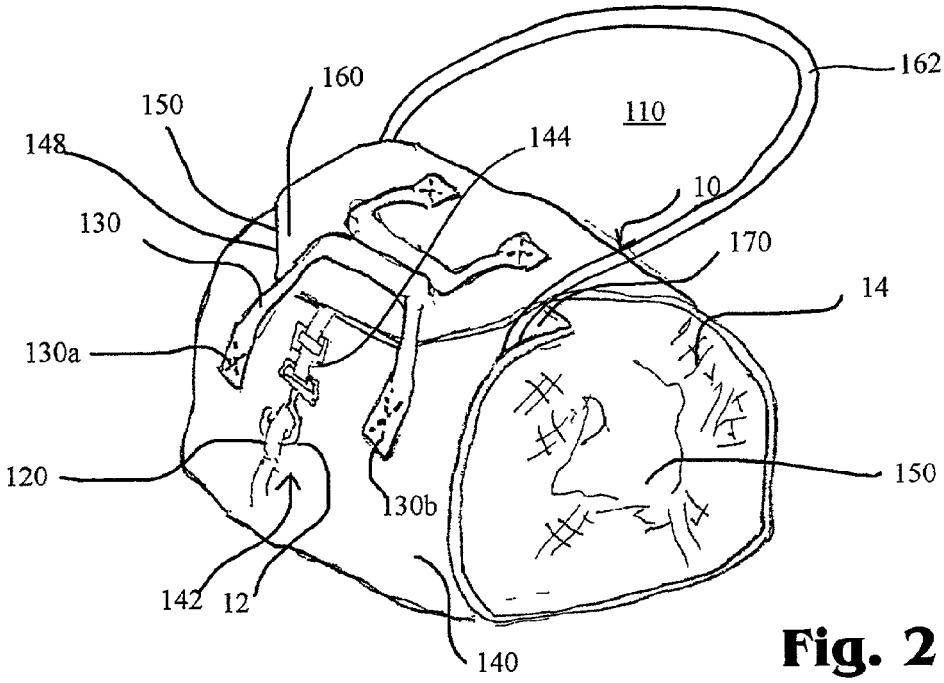
FIG. 2 is a view of a bag having the object holder of FIG. 1 folded up and having handles for hand carrying.

Referring to FIG. 2, the object holder 10 in one embodiment can be folded up or rolled up to form a bag 110 allowing for the object holder 10 to be carried. The rolling or folding also keeps the equipment inside relatively stationary within the bag 110 when the bag 110 is closed. The jiggling of large or small equipment can otherwise cause damage to the equipment and create noise when transporting. The hook 12 or other similar fastening device is detachably connected to a sleeve or loop 120 formed on the back side 140 of the back wall 16 of the object holder 10. Using the hook 12 to fasten together the bag 110 helps to avoid adding other components to the bag 110, thereby reducing the cost of manufacture. Other types of fasteners can also be used. The adjustable hooking mechanism 142 including the hook 12 and the adjustment portion 144 attached at the top of the object holder 10 allows a user to hang the bag 110 up to access the objects stored in the bag 110 and allow for air flow into the objects. The adjustable hooking mechanism 142 by adjusting the length of the adjustable strap 146 through the adjustment portion 144, also allows the bag 110 to still ventilate while the bag is in a closed position when the hooking mechanism 142 is connected to the sleeve 120. Although the ventilation in the closed position is much less than when the bag 110 is in the open position. The adjustable strap can provide some air flow into the bag 110 if it is loosened slightly. Even when tightly fastened, some air flow is still allowed through the unattached sides 148 of the object holder 10. Air flow is also allowed through the open sides 150 of the bag 110. When the bag 110 is folded, on the left and right sides have open sides 150 to allow for air ventilation. The mesh material 14 of the compartments are also exposed on the open sides 150 to ventilate the bag. Since, the bag has open sides 150 on both sides of the bag, this allows for a cross ventilating airflow that makes the drying more efficient. The bag 110 in an opened position such as when the bag 110 is hung or laid flat on a bench is the most efficient method of ventilating and drying the objects held by the bag. However, the structure of the bag also allows for a certain amount of ventilation while the bag is in a closed position such as when the hook 12 is secured to the sleeve 120. The object holder 10 can be laid in any space available such as the back seat or in the trunk of a vehicle while transporting the bag 110. For instance, sports teams may lay the bag 110 on the grass outside for drying. The equipment stays together and is easily returned to the original position for moving to another location. Since the hook 12 is attached to the adjustable strap 146 allowing the bag 110 to be adjusted to rest on the floor for instance, thereby taking the weight off the bag 110 and support.

Figure 18:
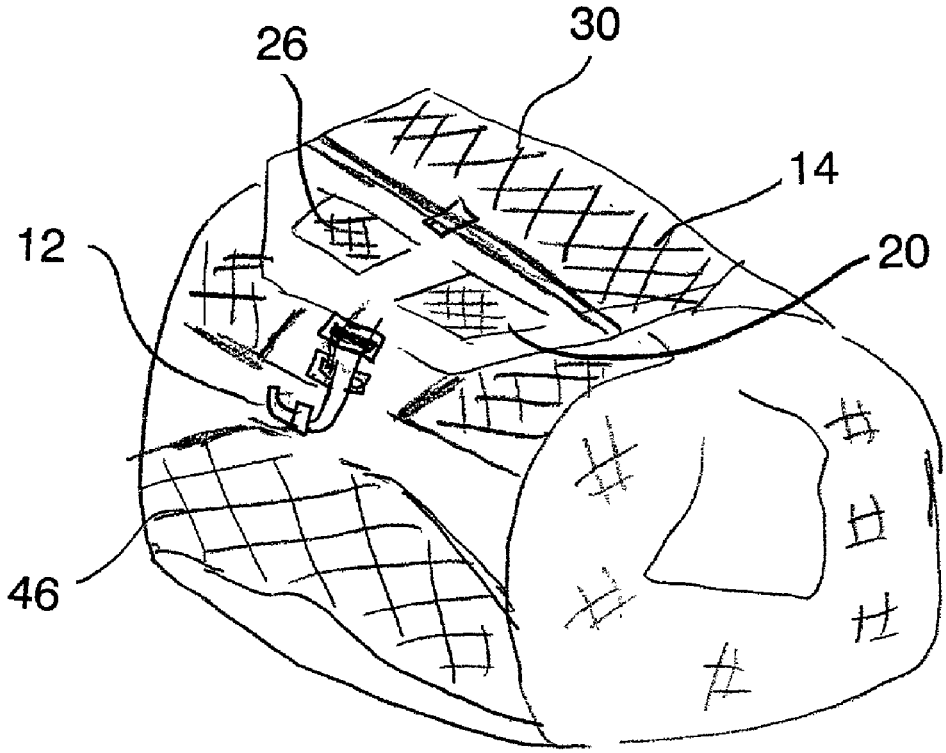
FIG. 18 is a view of a bag folded in reverse.

To allow for an efficient way to transport the bag 110, a handle 130 is attached to the back side 140 of the top portion 160 and another handle 130 is attached to the bottom portion 170 of the object holder 10. The handles 130 can for example be attached to the left 130*a* and right side 130*b* to the object holder 10 to allow for a user to grasp with a hand both handles 130 so that the bag 110 can be transported. Referring to FIG. 18, the bag can be folded in reverse with the compartments on the outside allowing for ventilation.

The top portion 160 can for example overlap the bottom side 170 of the object holder 10 in order to fasten the bag together. The opposite arrangement can also be true where the bottom portion 170 overlaps the top portion 160. In another arrangement, neither the top portion 160 or the bottom portion 170 overlaps each other. Other types of securing mechanisms can be used to close the bag 110 such as a zipper or other types of fasteners. The bag 110 can also have a shoulder strap 162.

Figure 3:
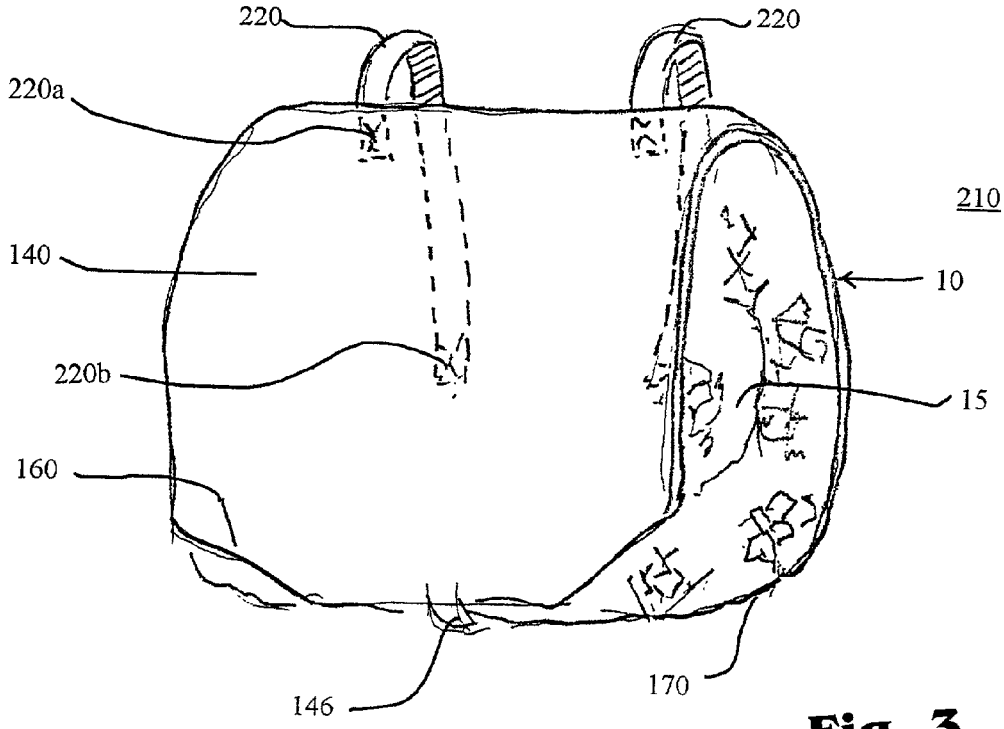
FIG. 3 is a view of a bag having straps attached to the object holder of FIG. 1 folded to provide a backpack.

In another embodiment of the present invention, as seen in FIG. 3, the object holder 10 can be folded to form backpack or bag 210 allowing a user to have one or both handles 220 supported by the shoulders of a user. For example, the top portion 160 can be folded to meet with the bottom portion 170 of the object holder 10 to connect the two sides using the adjustment strap 146. The backpack 210 can be connected in the same way as in seen by the bag 110 or in some other similar fashion allowing for the adjustment connection between the top portion 160 and bottom portion, or no adjustment, but just a connection between the two portions of the object holder 10. The pair of handles 220 can for example be placed on one side of the object holder on opposite ends of the back side 140 of the object holder. The position of the handles are such that a user can carry the backpack 210 on both shoulders at the same time if needed. The top portion 220*a* of the handle 220 is coupled on the top portion of the backpack 210 and the bottom portion 220*b* of the handle 220 is positioned below the top portion 220*a* of the handle 220. Other configurations of the handles 220 can be made as long as a user may carry the bag 210 on both shoulders at the same time. A V-shaped compartment such as the sixth compartment 46 is not preferable in a the backpack 210 when the backpack 210 is typically more narrow in shape.

Figure 4:
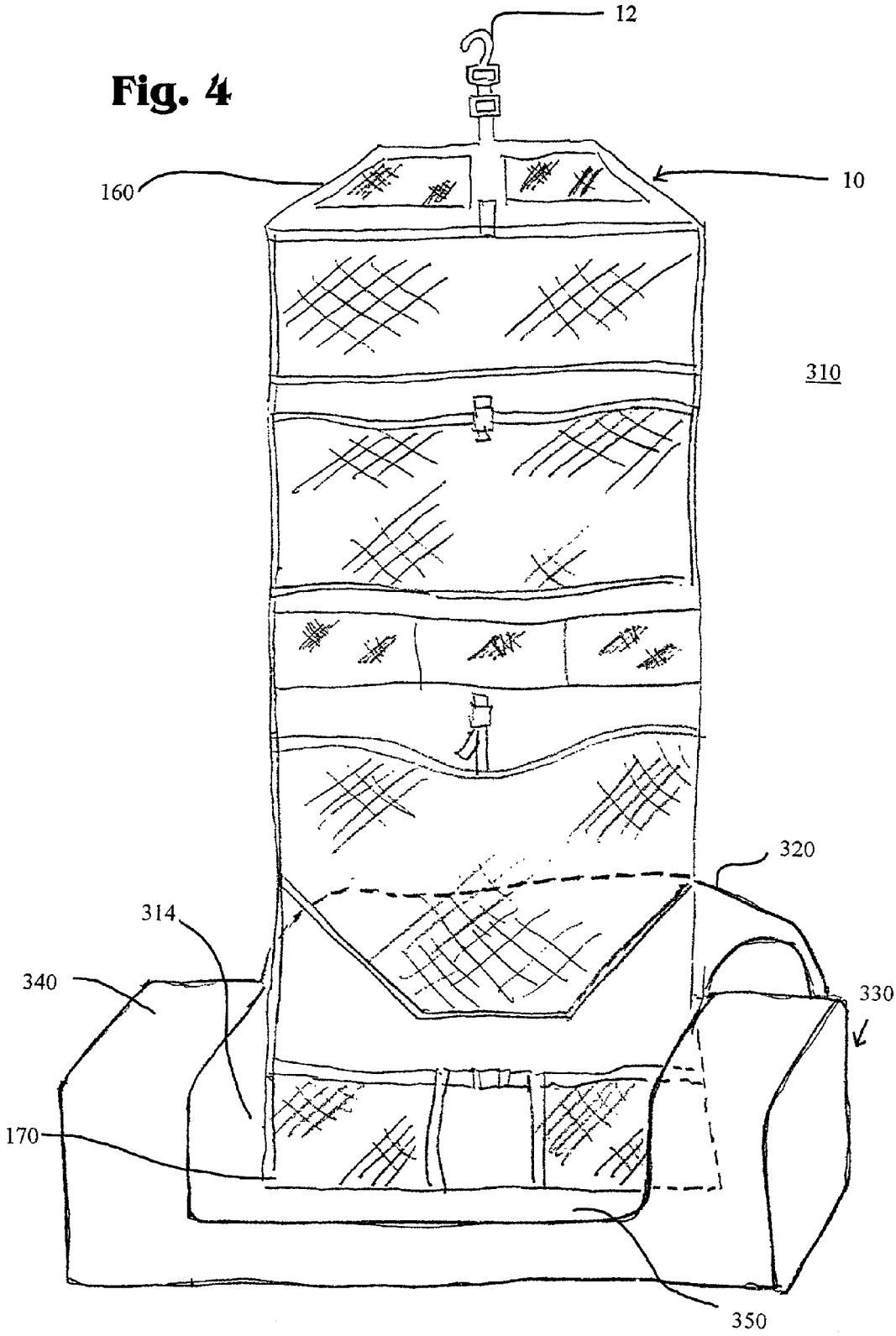
FIG. 4 is view of another embodiment having the object holder of FIG. 1 connected to the inside portion of a container portion of the bag.

In another embodiment of the present invention, as seen in FIG. 4, the object holder 10 has a bottom portion 170 connected to an internal section 314 of a container portion 330 to form a bag 310. The container portion 330 can be for example be rectangular in shape with a top portion 340 cut out into a flap 320 that can close the compartment 350 within the container portion 330. The flap 320 for example may close the container portion 330 by a zipper for example or other similar device. When the flap portion 320 is unattached from the container portion 330, the object holder 10 can be raised out of the container portion 330 allowing the object holder 10 to be hung by the hook 12 or laid flat on a surface. The container portion 330 allows for a convenient storage or hanging of the object holder 10. The container portion 330 also provides for further storage of items. The container portion can be have a rectangular shape or any other type of shape depending on the use and size of the objects.

Figure 5:
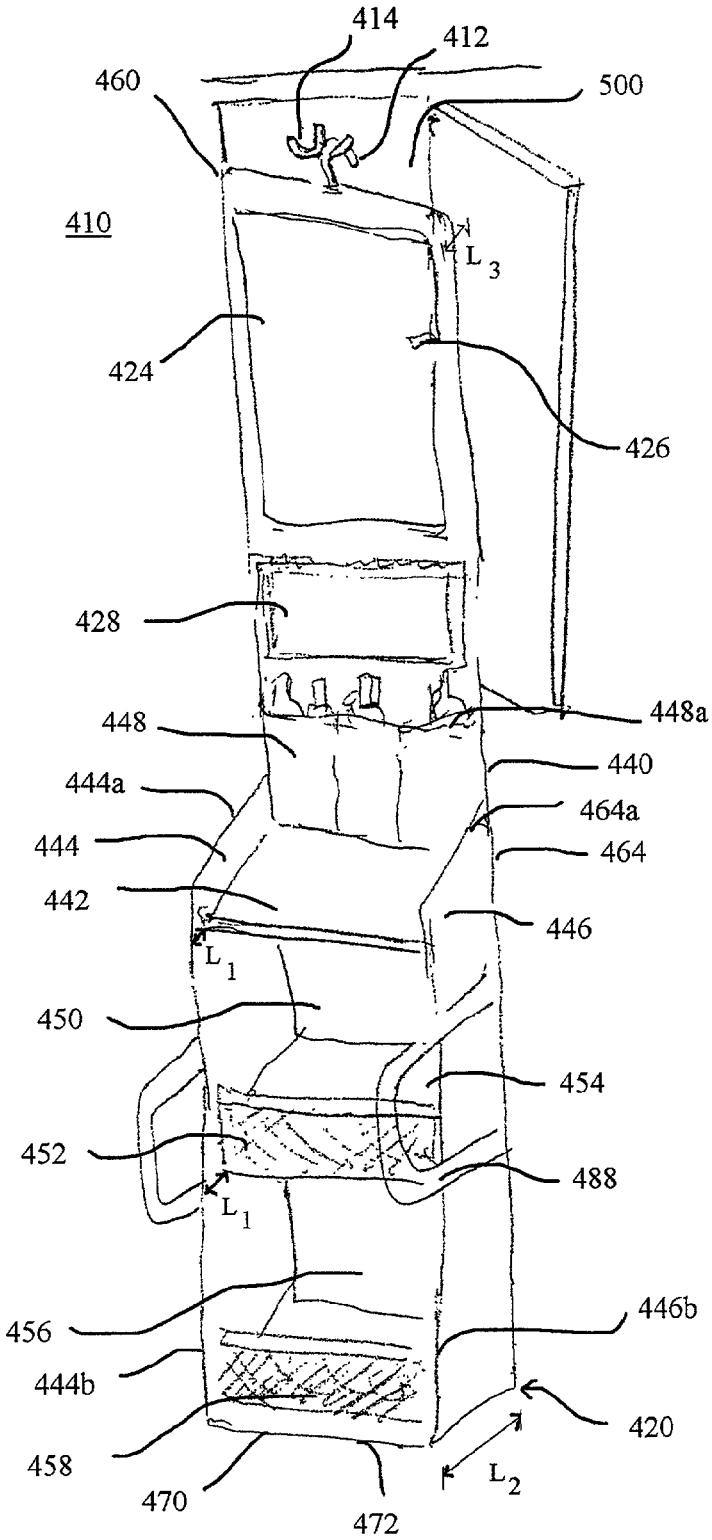
FIG. 5 is a plan view of an object holder of another embodiment in an opened position.

In another embodiment of the present invention, as seen in FIG. 5, the object holder 420 can have a portion such as the bottom portion 470 have shelves that project out of the back wall 440. The object holder 420 when opened can be hooked to locker hook 414 for example or any other location that can support a hook 412. A first compartment 424 can be closed with a zipper 426 to hold a variety of objects. A mirror 428 just below the first compartment 424 is added for uses such as applying make-up, tying a man's tie, or other uses where a mirror is appropriate. Below the mirror 428 is a second compartment 448 holding objects in a vertical position with respect to the vertically hung bag 410. Objects such as toiletries such as shampoo and conditioner may be inserted into the second compartment 448 through an opening in the upper portion 448*a*. The compartment may or may not be of a mesh (netted) or see-through material allowing for a quick view of the internal objects and also allow for ventilation of the objects.

A first shelf 442 projects out of the back wall 440. The first shelf 442 has side walls 444 and 446 that accommodates the closing of the object holder 420 to form a bag 410. The side walls 444 and 446 and shelf 442 accommodates the width of the objects in the second compartment 448. The second compartment 448 is located above the first shelf 442 towards the middle portion 464 of the object holder 420. The first shelf 442 is set back a predetermined distance $L_1$ to allow the top portion of the object holder to close the object holder to form a bag 410. The set back of $L_1$ provides an even surface of the bag 410 when the bag 410 is closed for transporting as seen in FIG. 6.

The left and right side walls 444 and 446 extend from the middle portion 464 to the end of the bottom portion 470 of the object holder 420. The side walls 444 and 446 accommodate a a third compartment 450 and a fourth compartment 456. The third compartment is bordered by the back wall 440 on a back side, the first shelf 442 being a top side, the left and right side walls 444 and 446, and the second shelf 454 as the bottom portion of the third compartment 450. A mesh (netted) strip 452 is connected from a portion of the left side wall 444 to a portion of the right side wall 446. The mesh strip 452 is also connected to a second shelf 454. The mesh strip 452 covers only a portion of the opening of the third compartment 450. The third compartment 450 accommodates a horizontal loading of objects when the object holder 420 is hanging open vertically. The mesh strip 452 contains the objects within the third compartment 450 so that the objects will not fall out of the object holder 420 when the object holder 420 is hung. Since the mesh strip 452 encloses only a portion of the opening of the third compartment 450, there is easy and quick access for a user to insert various objects within the compartment. The mesh strip 452 because of the mesh material accommodates a user to be able to view the contents in their entirety while still allowing for an increased ventilation of the objects within the third compartment 450. The third shelf 454 is set back in the compartment from the outer edge of the side walls 444 and 446 a predetermined distance similar to the set back of the first shelf. The set back distances can be varied also if needed.

The fourth compartment 456 located below the third compartment is constructed in the same manner as the third compartment. The opening of the fourth compartment 456 is partially enclosed by the mesh (netted) strip 458 while the bottom shelf 472 serves as the bottom portion of the fourth compartment and also an end portion of the object holder 420. The third shelf 472 is not set back from the outer edges 444*b* and 446*b* of the side walls 444 and 446, respectively like the first and second shelf 442 and 454. However, the mesh strip 458 is set back from the outer edges 444*b* and 446*b* to accommodate the closing the bag 410 with the top portion 460 of the object holder 420 being folded over in the set back area of $L_1$.

The top portion 460 of the object holder 420 has a width $L_3$ much smaller than the width $L_2$ of the third self 420. The thinner top portion 460 then can fold within the set back area of $L_1$ and fit in gap between the top sides 444*a* and 446*a* of the left and right side walls 444 and 446. Then the top portion 460 is folded around the first, second, and third shelves 442, 454, and 472 within the set back width $L_1$.

A handle 488 is connected on the left side wall 444, and another handle 488 is connected on the right side wall 446 so that when closed, the bag 420 can be easily transported as seen in FIG. 6. A zipper 480 for example can be located adjacent to the outer edges 444*b* and along the top portion 444*a* of the side wall 444. A second zipper 482 for example can be located adjacent to the outer edges 446*b* and along the top portion 446*a* of the side wall 446. The two zippers 480 and 482 run the length of the bag 410 to allow the unfolding and hanging of the bag 410 on a hook 414 for example. The two zippers 480 and 482 can also be a single zipper having two sliding parts on each side of the bag closing and opening the interlocking tabs disposed along the length of the bag.

The two zippers 480 and 482 have the sliding parts 480*a* and 482*a*, respectively, connected together by a locking bar 490. When the bag 410 is closed, the locking bar 490 inside for instance between the doors 510 and the body 520 of a gymnasium locker 500. The locking bar 490 is wider $L_4$ than the width $L_5$ of the gymnasium locker 500. The locking bar 490 can also be an object of another shape such that the dimensions of the object exceed the opening dimensions between the door and the locker once the locker is closed. For example, when the object is spherical, the diameter exceeds the opening distance "d" between the door 510 and the body 520 of the locker 500, so that the object cannot be removed from the closed locker. Once, the gymnasium locker 500 is secured by for instance a lock 530, the bag 410 is held in place by the locked door 510. A thief will not be able to pick up the bag 410 without having to rip open the bag 410. When the bag 410 is in the closed position as shown in FIG. 6, the bag itself may be secured, such that when the bag 410 has the locking bar 490 within the gymnasium locker 500, the bag 410 cannot be opened. This allows a user to have open access to bag 410 even when the locker 500 is closed without having to worry about if someone will steal the bag. The locking bar 490 also allows a user to not have to shove the bag within the locker 500. The bag 410 with the locking bar 490 can be opened and locked without having to move the bag. Furthermore, if the bag 410 is larger than the locker 500, it can still be securely used by being placed outside of the locker 500. Further, since the bag 410 can be placed outside of the locker 500, then more room is allowed within the locker 500 to store other objects. The bag 410 can be secured quickly to the locker 500 without having to add an extra securing mechanism. When the locker 500 is opened, a user can take the bag 410 with them.

The locking bar 490 can be made adjustable to accommodate different sizes of lockers 500.

Figure 12:
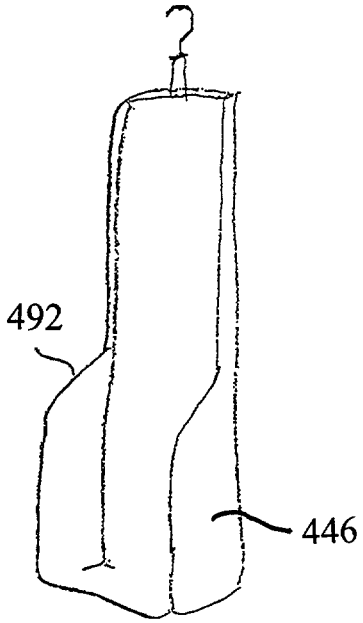
FIG. 12 is a plan view of the bag of FIG. 5 in an open position.
Figure 13:
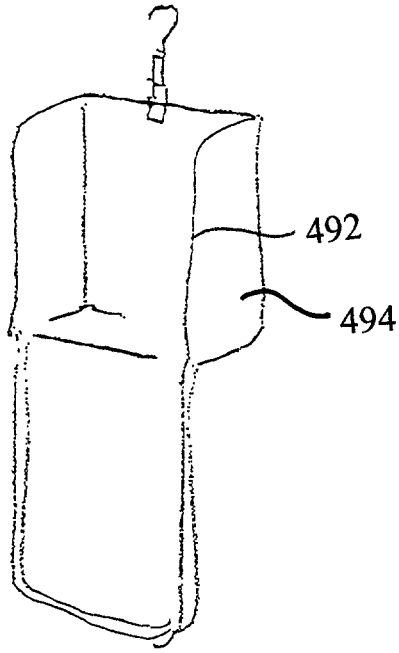
FIG. 13 is another embodiment of the opening of the bag of FIG. 5.
Figure 14:
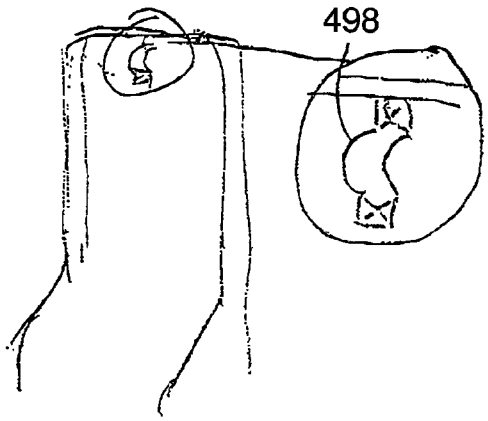
FIG. 14 is a view of a loop in the bag of FIG. 5.

The bag 410, which can be used for gymnasium activities for example, may have a plastic liner included to store wet clothing or a bathing suit. The bag 410 can have the zipper 492 along the edges of the walls open up with the side walls being on the bottom portion as seen in FIG. 12 or as seen in FIG. 13, the zipper 495 opens the bag having the side walls 494 being on the top portion where the top portion can be hooked to an door or shelf. As seen in FIG. 14, a loop 498 at the top of the bag allows hangers of clothes to be attached.

The object holder 420 as seen in FIG. 5, can also be enclosed as seen in the bag of 610 as seen in FIG. 7. The bag 610 has an object holder as seen in FIG. 7 such as the object holder 420 or the object holder 10. The object holder 620 has a pair of handles along the length of one side on the back wall 640 of the object holder 620. The handles 688 allow a user to carry the bag 610 around both shoulders on their back like a backpack. A zipper 680 or other connector type closes the bag 610. Additional pockets 630 may be added to the outside of the bag 610 to allow additional storage and quicker access when the bag 610 is closed.

Figure 8:
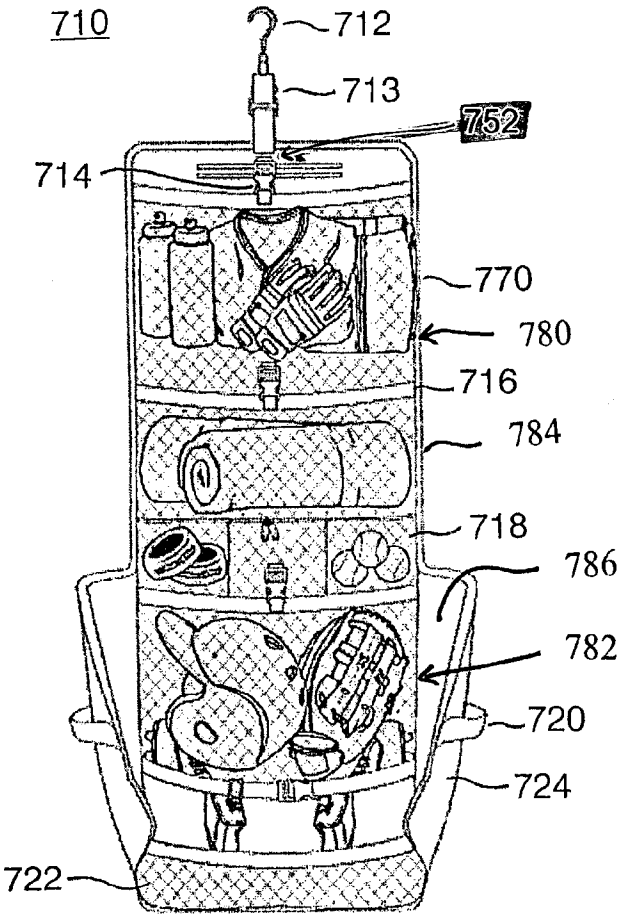
FIG. 8 is another embodiment of a backpack in an open position.

A backpack 710, as seen in FIG. 8 has a hook 712 that is shaped to hang on top of a door or other object. The hook 712 is attached to a strap 713 that can accommodate the bag to rest on the floor, thereby reducing the weight on the hanging structure. A clasp 714 are attached on the pockets 770 to help secure items inside. The clasp 714 can be substituted with velcro or other similar means. Elastic is sewn into the strap 716 to keep the strap 716 at the top of each compartment straight and assist in securing the items in the compartments. Smaller items are stored in the middle compartments 718 and are structured to allow the top to fold down smoothly. Side handles 720 are sewn into the side walls 724 to accommodate additional carrying options. A mesh wall 722 is used to hold any smaller items in the bottom and the wall 722 assists in holding the sides together.

Figure 9:
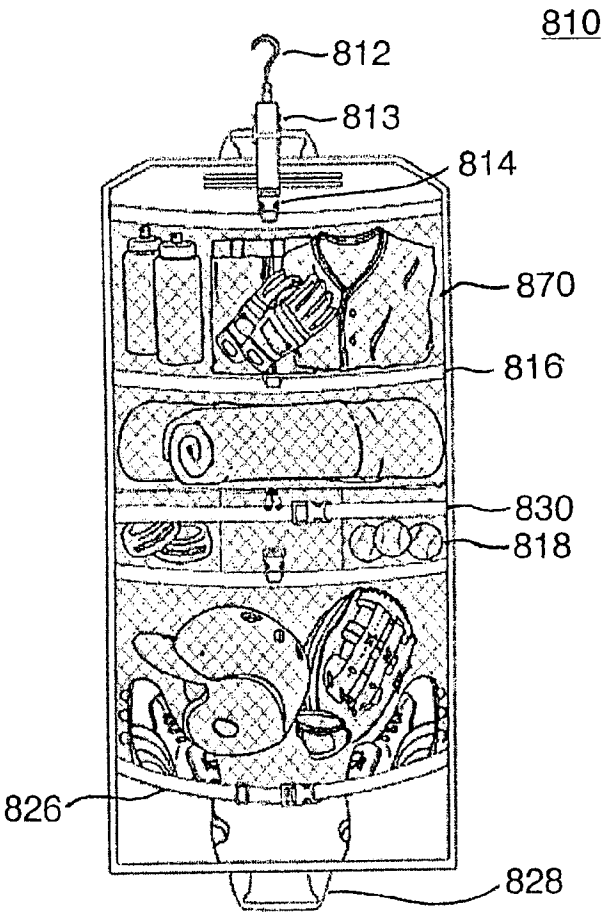
FIG. 9 is another embodiment of a handbag in an open position.
Figure 16:
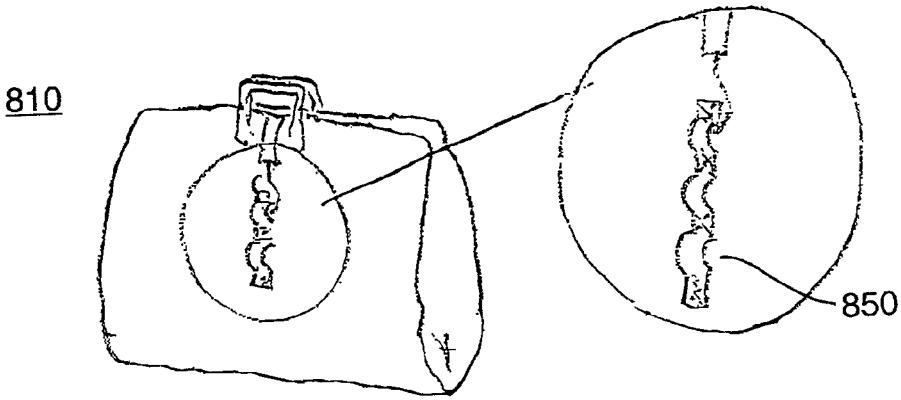
FIG. 16 is a view of the bag of FIG. 9 in the closed position with loops for attaching a hanging hook for secure closing.

In another embodiment, as seen in FIG. 9, the bag 810 has a hook 812 for hanging on top of a door or other stationary structure. The hook 812 is attached to a strap 813 that allows the bag to rest on the floor, thereby reducing the weight on the hanging structure. A clasp 814 are attached on the compartments 870 to help secure items inside. The clasp 814 can be substituted with velcro or other similar means. Elastic is sewn into the strap 816 to keep the strap 816 at the top of each compartment straight and assist in securing the items in the compartments. Smaller items are stored in the middle compartments 818 and are structured to allow the top to fold down smoothly. Handles 828 are connected to the top and bottom portions of the bag to accommodate the carrying of the bag 810. An adjustable strap 830 can hold additional items or hold in place items such as clothes. Referring to FIG. 16, the bag 810 has a webbing attached to the outside of the bag 810 to allow securing of the hook 812 and holding the bag closed.

Figure 10:
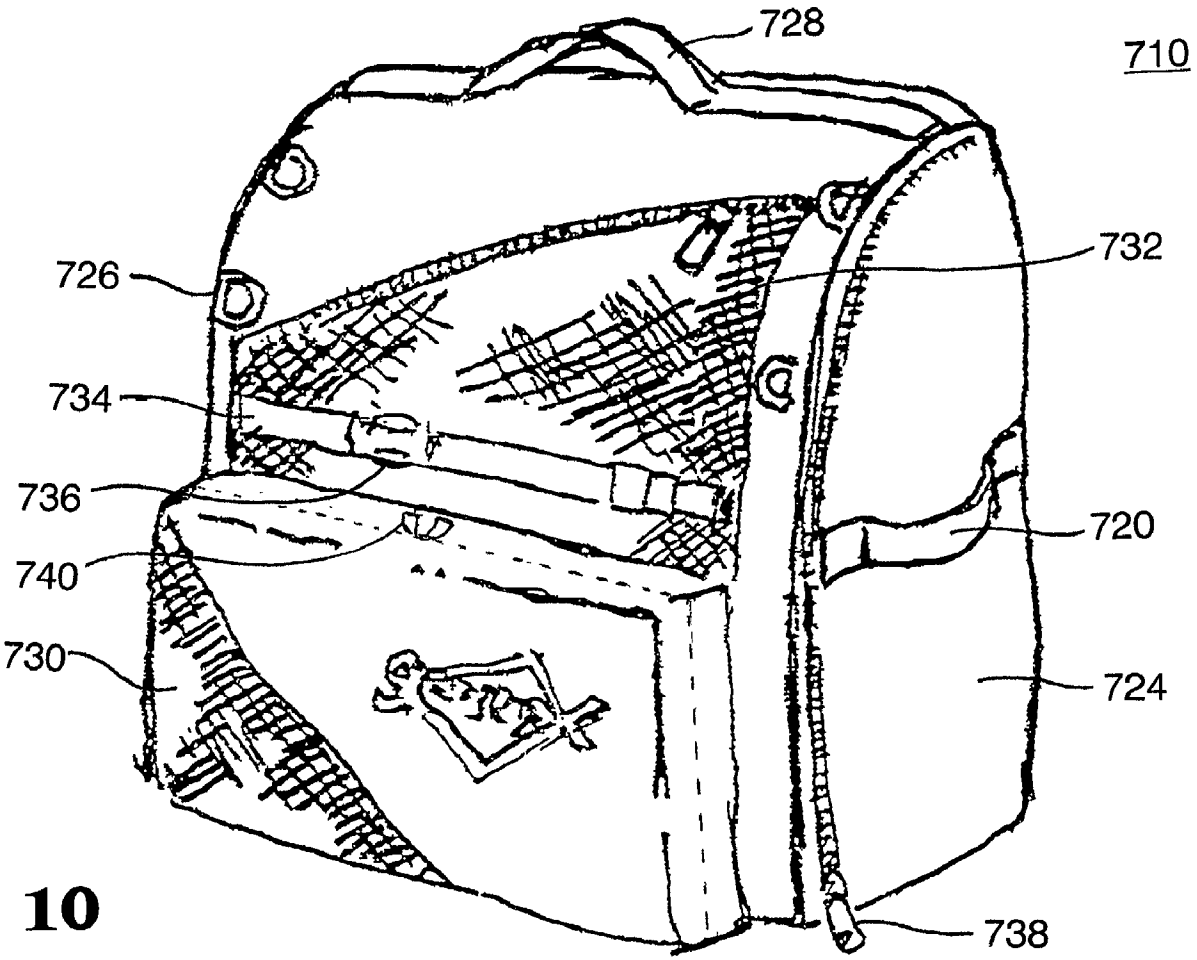
FIG. 10 is a backpack in a closed position.
Figure 17:
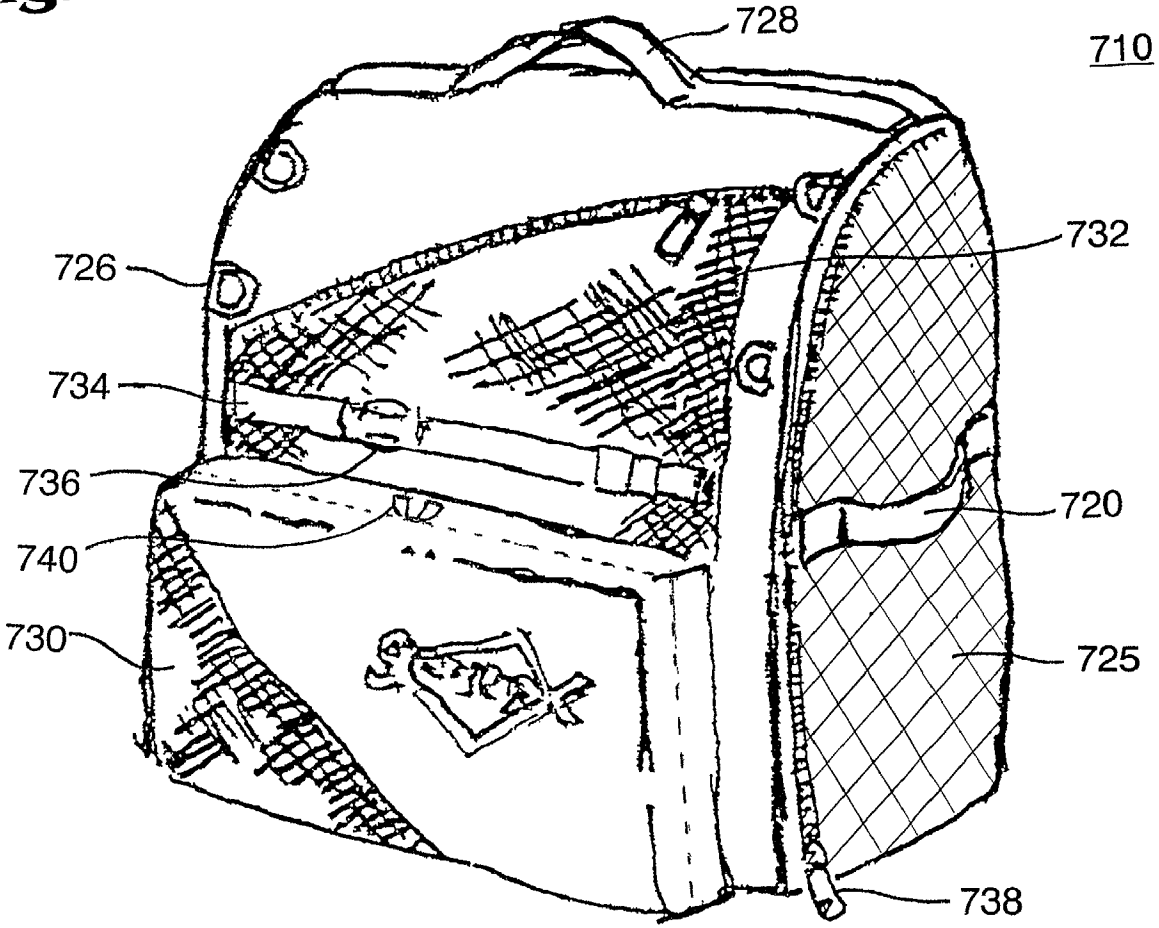
FIG. 17 is view of the backpack of FIG. 10 having a mesh sidewall.

As seen in FIG. 10, the backpack 710 is in a closed position. The backpack 710 has a top mesh pocket 732 and a bottom mesh pocket 730. Each of the pockets has only a portion that is made of mesh material and the remaining portion of the pockets being of solid material that is not see-through. Solid material that is not see-through is a material that one cannot see through with an unaided eye. The mesh materials 730 and 732 accommodate a ventilation of the pockets. The bottom pocket with the mesh material 730 can have door zippers 740. I-rings are attached to the front portion of the closed backpack to allow for attachments such as bungee cord to attach additional items such as camping equipment or snowboards. An adjustable strap 734 is transversely disposed near the middle section of the front portion of the closed backpack 710. The adjustable strap 734 can secure bulky items such as butt-pads for ice hockey. The butt-pads for instance can hook to the outside with the adjustable clasp 736. The adjustable strap 734 allows for the size of the backpack 710 too be not excessively large since the adjustable strap can take care of extremely bulky equipment. Since, the backpack 710 can be carried on the back of a user, an excessively large bag may not be desirable. A handle 728 is attached to the top portion of the backpack 720 allowing further flexibility for a user to carry the backpack 710. The backpack 710 can be closed from an open position as seen in FIG. 8 to the closed position as seen in FIG. 10 with a zipper 738 or other fastening means. The side walls 724 can be of a solid material that may or may not accommodate ventilation or the side walls can be of a mesh material 725 as seen in FIG. 17 that accommodates a ventilation of the inside of the bag 710 through the side walls. The mesh material 725 being on the side walls (on both sides of the bag) is important because all the inner compartments 770 can be ventilated properly. If both side walls are made of a material that allows ventilation like the mesh material 725, then a cross vent is created to increase the ventilation of the inner compartments (pockets) 770. Furthermore, because the material mesh 725 material is on the side walls, it is not so prone to being worn out as if it was on the front or back side of the bag. The side walls 724 extend from each side of the bottom portion 782 of the back wall 780 of the backpack 710 where the bottom portion 782 of the back wall 780 of the backpack 710 has a greater width than the top portion 784 of the back wall 780 of the backpack 710. The side walls 724 form angles with the extended portion 786 of the bottom back wall 782 of the backpack 710 accommodating a backpack that closes all sides which then stop any loose items that get out of the compartments 770 from being released from the bag 710.

Figure 11:
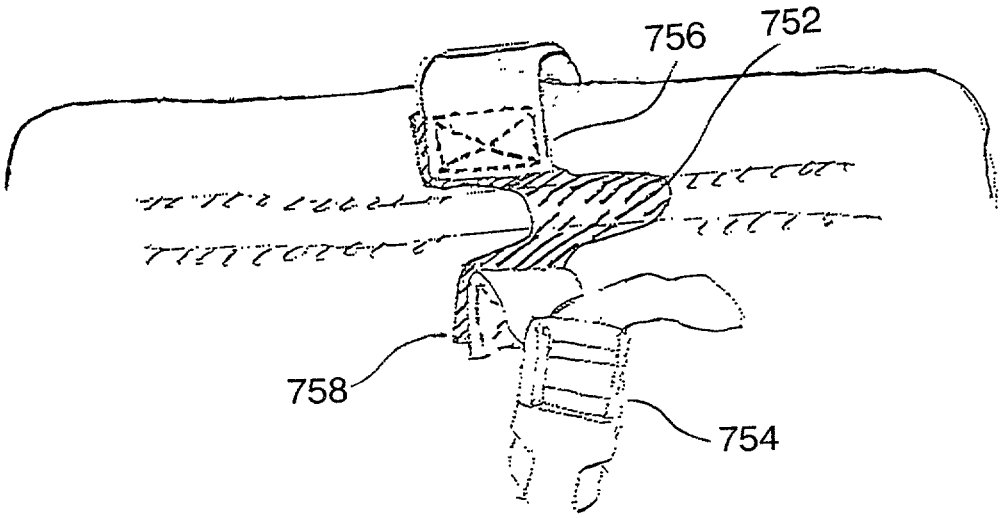
FIG. 11 is a strap of the backpack of FIG. 8.

Looking at FIG. 11, the backpack 710 (and also on bag 810) can have also a strap 752 secured to the top of the bag 710 that allows for clothes hangers to hang for jerseys or street clothes. A 1 inch webbing 756 under 1½ inch webbing is added before stitching. A 1 inch webbing is placed under top clasp before stitching. There must be enough slack allowed for attachment of hangers holding jersey or other clothes. The total webbing length being added appears to be about 6 inches. The 6 inches allows for one inch to be under the top webbing for securement and one inch to be under other clasp strap 758 with four inches exposed allowing for enough slack to hang hangers for jerseys and clothes. A clasp 754 is attached to the clasp strap 752 for hanging the jerseys or street clothes, etc.

Figure 15:
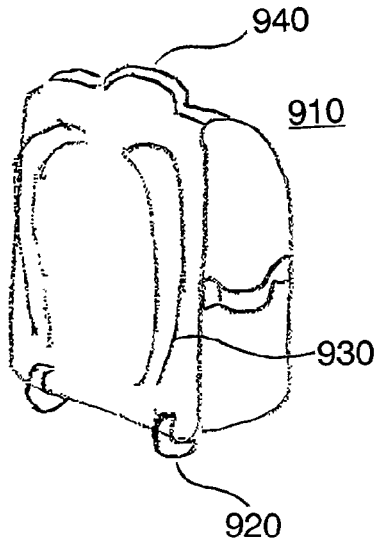
FIG. 15 is a plan view of the backpack of FIG. 8 having wheels.

Wheels can also be added to any of the above embodiments allowing a user to cart the bag. The backpacks 210, 610, and 710 may especially have wheels on a bottom portion allowing for a user to cart the backpacks 210, 610, and 710. Referring to FIG. 15, the backpack 910 is the same as backpack 710 except that backpack 910 includes a pair of wheels 920 that allows for the backpack 910 to be transported on the ground by rolling the backpack along the ground or other surface by pulling from the handle 940. The backpack 910 further includes a pair of straps 930 accommodating a user to carry the backpack 910 on his or her back.

Figure 19:
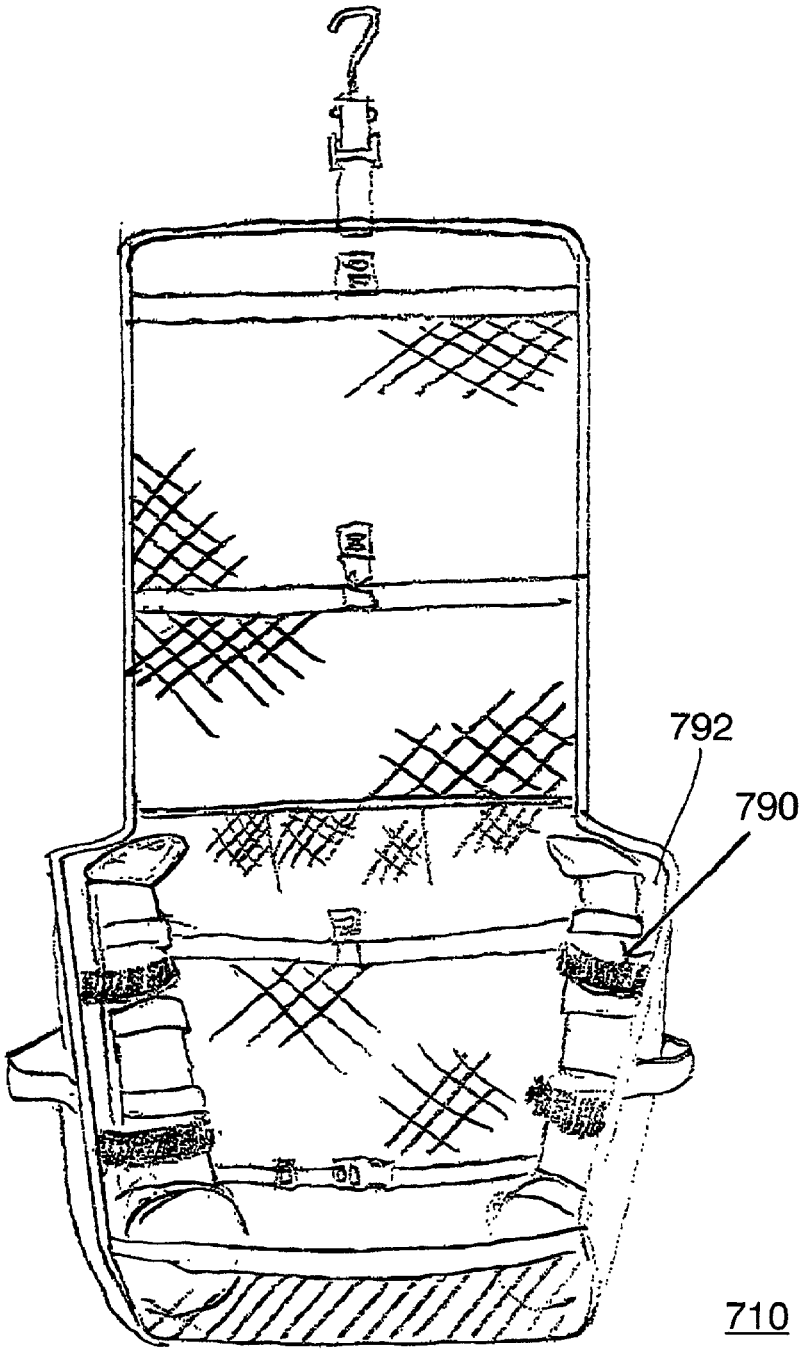
FIG. 19 is a view of a bag accommodating longer items.
Figure 20:
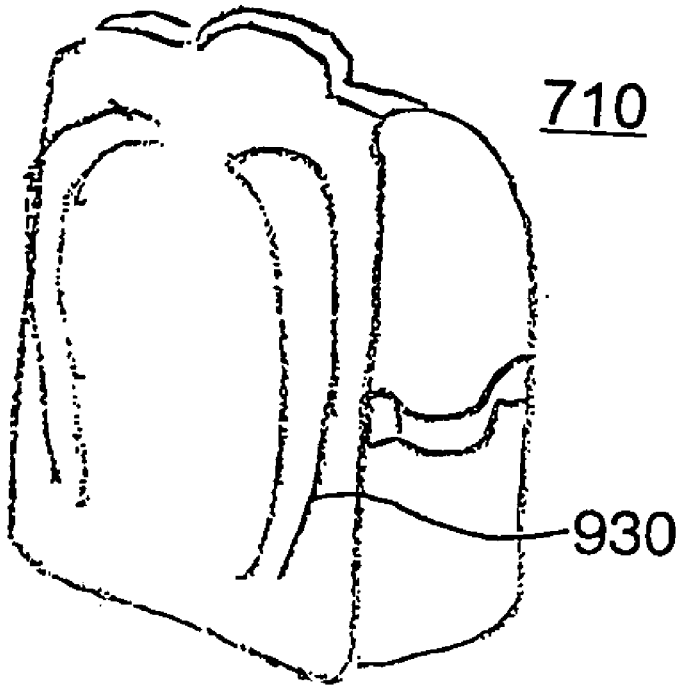
FIG. 20 is a back view of the backpack of FIG. 8.

Referring to FIG. 19, straps 790 can be used to secure longer items 792 to sides of the bag 710. The straps 790 may include fasteners such as velcro, clasps and other means of attachment. The straps 790 can be elastic allowing a user to slide items in the openings. Mesh pockets can also be used for holding the longer items 792 in place.

As seen above, the present invention provides for a bag and organizer that is equipped with a method of air circulation to effectively air dry articles without complex and expensive structures as well as being an organization and space saving tool. The bag provides for a quick inventory and access of the objects organized within the bag. The bag also provides for an easy mechanism of locking the bag to a stationary object.

While the invention has been particularly shown and described with reference to the preferred embodiments thereof, it will be understood by those skilled in the art that the foregoing and other changes in form and details may be made therein without departing from the spirit and scope of the invention.

What is claimed is:

1. A backpack, comprising of:

a back wall;

a hook connected to a top side of said back wall, said hook capable of hanging said back wall to an object, external to said backpack;

a plurality of compartments on a front surface of said back wall, the plurality of compartments including a front portion comprised of netted material accommodating a circulation of air within said compartments, said compartments accommodating a plurality of objects;

a pair of shoulder straps disposed a predetermined distance from each other along the longitudinal side of the back surface of said back wall to accommodate a carrying of said backpack by the shoulders and the back of a user; and wherein said backpack is secured by a fastening unit after said backpack is folded to a closed position.

2. The backpack of claim 1, further comprising a first side wall and a second side wall attached to a first and second side of said back wall respectively, the first and second side walls disposed on opposite sides of said back wall, said first and second side walls being fastened to the sides of a top portion of said back wall when said back wall is folded.

3. The backpack of claim 2, further comprised of a bottom panel attached at an angle to said backwall, and to said first and second sidewalls.

4. The backpack of claim 3, wherein when said back wall is folded, a portion of said back wall having the shoulder straps that is folded is substantially flat.

5. The backpack of claim 4, with said back wall being folded by the top portion of said back wall being folded only frontally downwards towards the front portion of said bottom panel accommodating the fastening of one end of said back wall to the other end when said back wall is folded, and accommodating said first and second side walls extending from the bottom portion of said back wall being fastened to the sides of the top portion of said back wall when said back wall is folded, with the downward direction being parallel with the longitudinal direction of said shoulder straps along the longitudinal side of the back surface of said back wall, and with a zipper fastening and closing said backwall with said bottom panel not being at a lower portion of the back surface of said backwall having said shoulder straps.

6. The backpack of claim 5, with a length of said first and second side walls being greater than a width of said back wall.

7. The backpack of claim 3, further comprising means for accommodating the hanging of hangers for clothes on the top portion of the front side of said back wall.

8. The backpack of claim 4, further comprising a front wall formed at the front edge of the bottom panel of said backpack and assisting in holding said first and second side walls together to form a bottom cavity for holding objects at the bottom.

9. The backpack of claim 1, further comprising at least one strap securing an object to said backpack.

10. A backpack, comprising:

a back wall;

a left wall and right wall extending from at least a portion of said back wall;

a bottom portion attached to a bottom of said back wall and said bottom portion connecting between a bottom of said right wall and said left wall;

a first wall extending from said bottom portion and assisting in holding a sufficient portion of said left and right walls together forming a bottom compartment;

a plurality of compartments on a front surface of said back wall, said plurality of compartments comprising a front portion comprising of at least a partially see-through material accommodating a circulation of air within said compartments, said compartments accommodating a plurality of objects, said plurality of compartments being disposed on a single plane accommodating full accessibility and a view of the objects within said plurality of compartments when said backpack is in an open position, said back wall folding to close said backpack, said compartments disposed from a top portion of the front surface of said back wall to a bottom portion of said back wall; and at least one back strap on an external surface of said backpack to accommodate shoulder and back transport of said backpack, on a user;

a first unit connected to a top side of said back wall, said first unit capable of hanging said back wall in the single plane to an external object; and a strap accommodating the hanging of garments along a length of said back wall.

11. The backpack of claim 10, with said back wall folding to close said bag by folding the top portion of said back wall to the front edge of a bottom portion of said back wall to couple with said bottom portion formed from a bottom of said backwall, said left wall and said right wall extending from the bottom portion of said back wall and upwards from said bottom of said backwall forming a bottom of said backpack.

12. A backpack, comprising:

a back member having a top, bottom and two sides;

curved side members affixed to each of said two sides of said back member and extending from a front side of said back member;

a bottom member connected to said bottom of said back member and each of said curved side members, said bottom member extending from said front side of said back member, said back member, said curved side members and said bottom member defining an internal volume;

a zipper positioned on said top of said back member and on said curved side members and said bottom member for selectively connecting and disconnecting said top of said back member to said curved side members and said bottom member;

a plurality of compartments formed on a front side of said back member at spaced apart locations, said compartments being within said internal volume when said zipper connects said top of said back member to said curved side member, said back member forming a single flat plane when in an opened position to accommodate an access and view of objects within said plurality of compartments included on an entire surface of said single plane, said compartments included on a substantial portion of said top and bottom of said back member; and backpack straps positioned on a back side of the bottom of said back member forming the single flat non-rigid plane on said back side of said back member when said backpack is open or closed.

13. The backpack of claim 12, further comprising a hook connected to said back member for hanging said back member to an external structure when said zipper is selectively disconnected with said top of said back member from said curved side members and said bottom member.

* * * * *